US007094093B2

(12) United States Patent
Nakano et al.

(10) Patent No.: US 7,094,093 B2
(45) Date of Patent: Aug. 22, 2006

(54) CONNECTOR

(75) Inventors: Yuki Nakano, Tokyo (JP); Masayuki Suzuki, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 11/272,413

(22) Filed: Nov. 10, 2005

(65) Prior Publication Data

US 2006/0105622 A1 May 18, 2006

(30) Foreign Application Priority Data

Nov. 18, 2004 (JP) ..... 2004-334060

(51) Int. Cl.
*H01R 12/24* (2006.01)

(52) U.S. Cl. ..... 439/495

(58) Field of Classification Search ..... 439/492–495
See application file for complete search history.

(56) References Cited

U.S. PATENT DOCUMENTS 5,580,272 A * 12/1996 Yamaguchi et al. ..... 439/495
5,947,764 A * 9/1999 Pan et al. ..... 439/492
5,967,831 A * 10/1999 Yamada et al. ..... 439/496
6,280,217 B1 * 8/2001 Lin ..... 439/260

FOREIGN PATENT DOCUMENTS

| | | |
|---|---|---|
| JP | H6-60983/1994 | 8/1994 |
| JP | H6-82783/1994 | 11/1994 |
| JP | H13-257020/2001 | 9/2001 |
| JP | 2004-221067 | 8/2004 |

* cited by examiner

*Primary Examiner*—Khiem Nguyen
(74) *Attorney, Agent, or Firm*—Baker Botts LLP

(57) ABSTRACT

Locking members installed in a housing of a connector each include a first piece having at one end an engaging portion to engage the anchoring portion formed in a flexible printed circuit board, a pressure receiving portion at the other end to be urged by a pivoting member, and a projection inwardly extending from the pressure receiving portion; a second piece having at one end a connection portion connected to a substrate; and a jointing fulcrum portion connecting the first and second pieces. When the engaging portions of the locking members engage the anchoring portions of the circuit board, the second pieces are void of parts facing to the engaging portions. The housing includes notches at positions corresponding to the locking members. The connector achieves further reduced overall height and stable holding force for the circuit board even with less conductors without failed connection.

15 Claims, 5 Drawing Sheets

CONNECTOR

CROSS-REFERENCE TO RELATED APPLICATIONS

This application claims priority from Japanese Patent Application No. 2004-334,060, filed Nov. 18, 2004, which is incorporated by reference in its entirety.

BACKGROUND OF THE INVENTION

The present invention relates to a connector for use in mobiles, backlight liquid crystal displays and the like, and more particularly to a connector capable of reliably locking a flexible printed circuit board to the connector when the circuit board has been inserted thereinto.

In general, connectors for use in mobile phones, charge coupled device (CCD) cameras and the like are much thinner and having contacts arranged in extremely narrow pitches (so-called lighter and more compact connector). A connector of one type mainly comprises a housing and contacts, and a flexible printed circuit board is inserted into the housing to bring the circuit board into contact with contact portions of the contacts (so-called "non-zero-insertion force (NZIF)" type). Moreover, another type connector mainly comprises a housing, contacts and a slider so that a flexible printed circuit board is embraced between the housing and the slider (so-called "zero-insertion force (ZIF)" type and "piano touch " type). Various methods may be envisioned for holding a flexible printed circuit board by means of the housing and the slider. In many cases, there have been constructions in which after a flexible printed circuit board has been inserted into a housing, a slider is inserted into the housing so that the circuit board is pressed against the contacts. Moreover, depending upon customer's demands or specifications and in the case that narrower pitches of contacts are desired, it may be unavoidable that connection portions of contacts should be located on the side of a fitting opening of a housing into which a flexible printed circuit board is inserted.

A housing may be usually formed with a required number of inserting holes for inserting contacts and a fitting opening into which a flexible printed circuit board is inserted.

In general, contacts each comprise a contact portion adapted to contact a flexible printed circuit board, a connection portion to be connected to a substrate or the like, and a fixed portion to be fixed to the housing. These contacts may be fixed to the housing as by press-fitting.

Exemplarily described in the following passages are Japanese Utility Model Application Opened No. H6-60,983/1994 (Patent Literature 1) as a "zero-insertion force (ZIF)" type connector, and Japanese Patent Application Opened No. H13-257,020/2001 (Patent Literature 2) as a "piano touch" type connector. Moreover, Japanese Utility Model Application Opened No. H6-82,783/1994 (Patent Literature 3) will be exemplified as a locking structure for a flexible printed circuit board. Further, Japanese Patent Application Opened No. 2004-221,067 (Patent Literature 4) filed by the applicant of the present case will be exemplified as a locking structure for a flexible printed circuit board.

Patent Literature 1

For example, Japanese Utility Model Application Opened No. H6-60,983/1994 discloses connectors of the "zero-insertion force" type. As can be seen from the "Abstract" of the Japanese Utility Model, this invention relates to a connector with a slider for a printed circuit board for use in a narrow space in an electronic or communication appliance.

The slider is formed at ends of both sides with U-shaped arms with their proximal ends fixed to the slider as guiding means when being inserted into a housing. The U-shaped arms are each provided on its opening side with a projection and formed with a notch such that the opening end is visible from the inserting side. The housing is provided at both the ends with projections having an oblique surface adapted to engage the projections of the slider. When the slider together with connection terminals of a flexible printed circuit board is inserted into the housing, the projections of the slider ride over the projections having the oblique surface of the housing so that the opening ends of the U-shaped arms of the slider are temporarily spread outwardly and then returned to their normal positions when the insertion has been completed.

Patent Literature 2

Japanese Patent Application Opened No. H13-257,020/2001 discloses one example of the so-called "piano touch" type connector. With a view to obtaining an accurate positioning of contacts of the disclosed connector relative to patterns of a flexible printed circuit board or flat cable, projections are provided in a row on a line on a terminal block between the contacts. After a flexible printed circuit board or flexible flat cable has been inserted into the terminal block, a slider is moved to urge the circuit board or flat cable against the contacts. At the moment when the circuit board or flat cable is electrically connected to the contacts by the slider in this manner, the projections snap into recesses between patterns of the circuit board or flat cable, thereby ensuring positional coincidence between the contacts and patterns of the circuit board or flat cable.

Patent Literature 3

As a locking structure for a flexible flat cable, the Japanese Utility Model Application Opened No. H6-82,783/1994 discloses a connector. This utility model has an object to provide a connector provided with a slider having claws capable of anchoring even a flat cable reinforced by a rigid reinforcing plate attached to the rear side of the flat cable. In the connector including a housing having contact pins therein and formed with a fitting space into which a flat cable is inserted, and a slider adapted to be inserted into and removed from the fitting space and mounted on the housing to be pivotally movable outside the housing when the slider is removed therefrom, and the slider being forced into the fitting space after the flat cable has been inserted into the fitting space so that the flat cable is electrically connected to the contact pins, the slider is provided on its flat cable abutting surface with anchoring protrusions adapted to be inserted and anchored in anchoring portions formed in both the flat cable and the reinforcing plate attached to the rear face of the flat cable.

Patent Literature 4

According to the Japanese Patent Application Opened No. 2004-221,067, the object of this invention is to provide a connector ensuring a required holding force for a flexible printed circuit board without any defective or failed connection even with less conductors. In the connector detachably fitted with a flexible printed circuit board, including a required number of contacts each having a contact portion to contact the flexible printed circuit board, and a housing holding and fixing the contacts and having a fitting opening into which the flexible printed circuit board is inserted, the circuit board is provided with anchoring portions, and locking members each having an engaging portion adapted to engage said anchoring portion of the circuit board are installed into the housing so that the engaging portions of the locking members are caused to engage the anchoring portions of the circuit board, thereby preventing the circuit board from being removed from the housing, and grooves are provided at positions corresponding to said engaging portions to ensure a more reliable locking.

In recent years, requirements for less conductors such as four to ten conductors have progressively increased according to specifications of customers. A smaller insertion force of the flexible printed circuit board is better, while a larger holding force for the circuit board is better. In this manner, the opposed requirements are imposed on the insertion force and holding force concerning the flexible printed circuit board. In the "non-zero-insertion force (NZIF)" type connector described above, the insertion force and holding force for the flexible printed circuit board depend upon contact pressure (force) of the contacts. In other words, the holding force for the circuit board will be determined by a product of the number of contacts and contact pressure per one contact. When a customer's requirement for the holding force is 5N and the number of conductors is less than 10, it is impossible to obtain the holding force of 5N, resulting in removal of the circuit board causing a defective connection, which is a problem to be solved.

Even with the "zero-insertion force (ZIF)" type connector, that is, the case that after a flexible printed circuit board has been inserted into a housing, the circuit board is urged against contacts by means of a slider, this type only contributes to increase in initial value resulting from the insertion of the slider so that the contact pressure of contacts still has a great influence on the holding force for the circuit board. Therefore, when a customer's requirement for the holding force is 5N and the number of conductors is less than 10, it is still impossible to obtain the holding force of 5N, resulting in removal of the circuit board causing a defective connection, which problem remains to be solved.

Moreover, even with the structure that anchoring protrusions provided on a slider are inserted and anchored into anchoring portions of a flexible flat cable as is the case with the Patent Literature 3, the influence of the contact pressure of contacts is still great because the inserting directions of the slider and the flat cable are substantially the same. Accordingly, when a customer's requirement for the holding force is 5N and the number of conductors is less than 10, it is still impossible to obtain the holding force of 5N, resulting in removal of the circuit board causing a defective connection, which problem could not be solved.

It may be considered to combine the features of the Patent Literatures 2 and 3, that is, to add the locking structure consisting of anchoring portions provided in a flexible printed circuit board and anchoring protrusions provided on a slider as disclosed in the Patent Literature 3 to a connector of the so-called "piano touch" type as disclosed in the Patent Literature 2. Such a connector would be able to acquire a required holding force for a flexible printed circuit board even with less conductors because of difference between the inserting direction of the circuit board and the direction of rotation of the slider. However, as the slider has no elasticity, if the circuit board is forcedly pulled by a force larger than the holding force, the slider or the flexible printed circuit board would be damaged. When a circuit board is unintentionally subjected to external forces, moreover, the circuit board would be usually pulled obliquely upward rather than a direction opposite to the inserting direction of circuit board. In such a case, the direction of the pulling force acting upon the circuit board and the direction of the pivotal movement of the slider are substantially coincident with each other so that frequently a required holding force could not be maintained.

Therefore, the applicant of the present case has proposed a structure provided with grooves at positions corresponding to the engaging portions of the locking members in the Patent Literature 4. Such a structure can obtain a stable holding force more than 3N. In recent years, however, the requirement for more reduced overall height of connectors has become stronger. With the locking members constructed as in the Patent Literature 4, the further reduced overall height would be difficult.

SUMMARY OF THE INVENTION

It is an object of the invention to provide an improved connector which overcomes all the disadvantages of the prior art and which ensures a stable holding force for a flexible printed circuit board even with less contacts without causing defective or failed connection and achieves further reduced overall height of the connector.

The above object can be achieved by the connector 10 detachably fitted with a flexible printed circuit board 80, including a plurality of contacts 14 each having a contact portion 64 to contact the flexible printed circuit board 80, a housing 12 holding and fixing the contacts 14 and having a fitting opening 40 into which the flexible printed circuit board 80 is inserted, locking members 18 adapted to engage the flexible printed circuit board 80, and a pivoting member 16 causing the contacts 14 and the locking members 18 to be elastically deformed, wherein according to the invention the flexible printed circuit board 80 is provided with anchoring portions 82, and the locking members 18 each comprise a first piece 20 having an engaging portion 24 at one end adapted to engage the anchoring portion 82 of the flexible printed circuit board, a pressure receiving portion 26 at the other end adapted to be urged by the pivoting member 16, and a projection 34 inwardly extending from the tip of the pressure receiving portion 26; a second piece 22 having a connection portion 30 at one end or the other end to be connected to a substrate; and a jointing fulcrum portion 32 for connecting the first piece 20 and the other end or the one end of the second piece 22; the locking members 18 being installed on the housing 12, and wherein the housing 12 is provided with notches 42 on the side of its upper surface at positions corresponding to the locking members 18.

The above object is also achieved by the connector 10 detachably fitted with a flexible printed circuit board 80, including a plurality of contacts 14 each having a contact portion 64 to contact the flexible printed circuit board 80, a housing 12 holding and fixing the contacts 14 and having a fitting opening 40 into which the flexible printed circuit board 80 is inserted, locking members 18 adapted to engage the flexible printed circuit board 80, and a pivoting member 16 causing the contacts 14 and the locking members 18 to be elastically deformed, wherein according to the invention the flexible printed circuit board 80 is provided with anchoring portions 82, and the locking members 18 each comprise a first piece 20 having an engaging portion 24 at one end adapted to engage the anchoring portion 82 of the flexible printed circuit board, a pressure receiving portion 26 at the other end adapted to be urged by the pivoting member 16, and a projection 34 inwardly extending from the tip of the pressure receiving portion 26; a second piece 22 having a connection portion 30 at one end to be connected to a substrate; and a jointing fulcrum portion 32 for connecting the first piece 20 and the other end of the second piece 22; the locking members 18 being installed on the housing 12, and wherein the second pieces are void of parts at positions facing to the engaging portions 24 of the first piece when the pivoting member 16 is pivotally moved to bring the engaging portions 24 of the locking members 18 into engagement with the anchoring portions 82 of the flexible printed circuit board 80.

In a preferred embodiment of the invention, the second pieces 22 are 0.08 to 0.12 mm in height. If the height of the second pieces 22 is higher than 0.12 mm, the reduced overall height could not be accomplished. On the other hand, if it is less than 0.08 mm, the strength of the locking members may become insufficient.

Preferably, the second pieces 22 each include an extension portion 28 extending from the jointing fulcrum portion 32 in such a direction that the extension portion faces to the engaging portion 24, and the length of the extension portion 28 is shorter than the distance from the jointing fulcrum portion to the engaging portion 24 so that the extension portions 28 stop short of the positions facing to the engaging portions 24 when the pivoting member 16 is pivotally moved to bring the engaging portions 24 of the locking members 18 into engagement with the anchoring portions 82 of the flexible printed circuit board 80.

It is preferable that the second pieces 22 are each provided with a fixed portion 36 between the tip of the extension portion 28 and the jointing fulcrum portion 32.

According to the invention, the contacts 14 each comprise a first piece 60 having a contact portion 64 at one end adapted to contact the flexible printed circuit board 80, a pressure receiving portion 66 at the other end adapted to be urged by the pivoting member 16, and a projection 74 inwardly extending from the tip of the pressure receiving portion 66; a second piece 62 having a connection portion 70 at one end to be connected to a substrate and at the other end an extension portion 68 extending from a fulcrum portion 72; and a jointing portion 73 for connecting the first piece 60 and the fulcrum portion 72 of the second piece 62; the contact portion 64, the jointing portion 73, the fulcrum portion 72, and the connection portion 70 are arranged substantially in the form of a U-shape, and further the pivoting member 16 comprises an actuating portion 44 for pivotally moving the pivoting member, urging portions 46 arranged continuously in the longitudinal direction, and anchoring holes 48 into which the pressure receiving portions 66 and 26 of the contacts 14 and the locking members 18 can be inserted, and the pivoting member 16 is installed on the housing 12 so that the urging portions 46 are pivotally moved between the pressure receiving portions 66 and the extension portions 68 of the contacts 14 and between the pressure receiving portions 26 and the connection portions 30 of the locking members 18.

Functions of the connector 10 according to the invention are as follows. When the flexible printed circuit board 80 is inserted into the fitting opening 40 of the housing 12, the circuit board does not contact or engage the contacts 14 and the locking members 18. Once the pivoting member 16 is pivotally moved to pivotally move the urging portions 46 of the pivoting member 16 between the pressure receiving portions 66 and the extension portions 68 of the contacts 14 and between the pressure receiving portions 26 and the connection portions 30 of the locking members 18 so that the urging portions 46 cause the pressure receiving portions 26 and 66 to be raised to lower the contact portions 64 of the contacts 14 and the engaging portions 24 of the locking members 18 about the fulcrum portions 72 of the contacts 14 and the jointing fulcrum portions 32 of the locking members 18 as fulcrums. In other words, when the flexible printed circuit board 80 is inserted into the connector 10, the connector 10 constitutes a "zero-insertion force" mechanism.

As can be seen from the above description, the connector 10 according to the invention brings about the following significant effects.

(1) In a connector 10 detachably fitted with a flexible printed circuit board 80, including a plurality of contacts 14 each having a contact portion 64 to contact the flexible printed circuit board 80, a housing 12 holding and fixing the contacts 14 and having a fitting opening 40 into which the flexible printed circuit board 80 is inserted, locking members 18 adapted to engage the flexible printed circuit board 80, and a pivoting member 16 causing the contacts 14 and the locking members 18 to be elastically deformed, according to the invention, the flexible printed circuit board 80 is provided with anchoring portions 82, and the locking members 18 each comprise a first piece 20 having an engaging portion 24 at one end adapted to engage the anchoring portion 82 of the flexible printed circuit board, a pressure receiving portion 26 at the other end adapted to be urged by the pivoting member 16, and a projection 34 inwardly extending from the tip of the pressure receiving portion 26; a second piece 22 having a connection portion 30 at one end or the other end to be connected to a substrate; and a jointing fulcrum portion 32 for connecting the first piece 20 and the other end or the one end of the second piece 22; the locking members 18 being installed on the housing 12, and further the housing 12 is provided with notches 42 on the side of its upper surface at positions corresponding to the locking members 18. Therefore, a simple construction of the locking members 18 ensures sufficient displacements of the engaging portions 24 of the locking members 18 and can reduce the overall height by about 0.13 to 0.17 mm.

(2) In a connector 10 detachably fitted with a flexible printed circuit board 80, including a plurality of contacts 14 each having a contact portion 64 to contact the flexible printed circuit board 80, a housing 12 holding and fixing the contacts 14 and having a fitting opening 40 into which the flexible printed circuit board 80 is inserted, locking members 18 adapted to engage the flexible printed circuit board 80, and a pivoting member 16 causing the contacts 14 and the locking members 18 to be elastically deformed, according to the invention the flexible printed circuit board 80 is provided with anchoring portions 82, and the locking members 18 each comprise a first piece 20 having an engaging portion 24 at one end adapted to engage the anchoring portion 82 of the flexible printed circuit board, a pressure receiving portion 26 at the other end adapted to be urged by the pivoting member 16, and a projection 34 inwardly extending from the tip of the pressure receiving portion 26; a second piece 22 having a connection portion 30 at one end to be connected to a substrate; and a jointing fulcrum portion 32 for connecting the first piece 20 and the other end of the second piece 22; the locking members 18 being installed on the housing 12, and further the second pieces are void of parts at positions facing to the engaging portions 24 of the first piece when the pivoting member 16 is pivotally moved to bring the engaging portions 24 of the locking members 18 into engagement with the anchoring portions 82 of the flexible printed circuit board 80. Accordingly, a simple construction of the locking members 18 ensures sufficient displacements of the engaging portions 24 of the locking members 18, and the connector 10 according to the invention can achieve a stable holding force fully complying with customer's requirements for a flexible printed circuit board and hence provide stable connection.

(3) According to the invention, the second pieces 22 are 0.08 to 0.12 mm in height. Therefore, the overall height of the connector can be reduced by approximately 0.05 mm, while maintaining a stable holding force for a flexible printed circuit board.

(4) According to the invention, the second pieces 22 each include an extension portion 28 extending from the jointing fulcrum portion 32 in such a direction that the extension portion faces to the engaging portion 24, and the length of the extension portion 28 is shorter than the distance from the jointing fulcrum portion to the engaging portion 24 so that the extension portions 28 stop short of the positions facing to the engaging portions 24 when the pivoting member 16 is pivotally moved to bring the engaging portions 24 of the locking members 18 into engagement with the anchoring portions 82 of the flexible printed circuit board 80. Therefore, as there are provided the notches 42 in the upper surface of the housing 12, a simple construction of the locking members 18 ensures sufficient displacements of the engaging portions 24 of the locking members 18, and the connector according to the invention can achieve a stable holding force fully complying with customer's requirements for a flexible printed circuit board and hence provide stable connection and further can reduce the overall height of the connector by approximately 0.2 mm.

(5) According to the invention, the second pieces 22 are each provided with a fixed portion 36 between the tip of the extension portion 28 and the jointing fulcrum portion 32. Therefore, the contacts 14 can be securely held in the housing 12 to achieve stable electrical connection.

(6) According to the invention, the contacts 14 each comprise a first piece 60 having a contact portion 64 at one end adapted to contact the flexible printed circuit board 80, a pressure receiving portion 66 at the other end adapted to be urged by the pivoting member 16, and a projection 74 inwardly extending from the tip of the pressure receiving portion 66; a second piece 62 having a connection portion 70 at one end to be connected to a substrate and at the other end an extension portion 68 extending from a fulcrum portion 72; and a jointing portion 73 for connecting the first piece 60 and the fulcrum portion 72 of the second piece 62; the contact portion 64, the jointing portion 73, the fulcrum portion 72, and the connection portion 70 are arranged substantially in the form of a U-shape, and further the pivoting member 16 comprises an actuating portion 44 for pivotally moving the pivoting member, urging portions 46 arranged continuously in the longitudinal direction, and anchoring holes 48 into which the pressure receiving portions 66 and 26 of the contacts 14 and the locking members 18 can be inserted, and the pivoting member 16 is installed on the housing 12 so that the urging portions 46 are pivotally moved between the pressure receiving portions 66 and the extension portions 68 of the contacts 14 and between the pressure receiving portions 26 and the connection portions 30 of the locking members 18. Accordingly, it is possible to provide a connector 10 which requires no force for inserting a flexible printed circuit board 80 with the aid of the simple construction of the contacts 14 similar to the locking members 18.

The invention will be more fully understood by referring to the following detailed specification and claims taken in connection with the appended drawings.

DESCRIPTION OF THE PREFERRED EMBODIMENTS

Figure 1A:
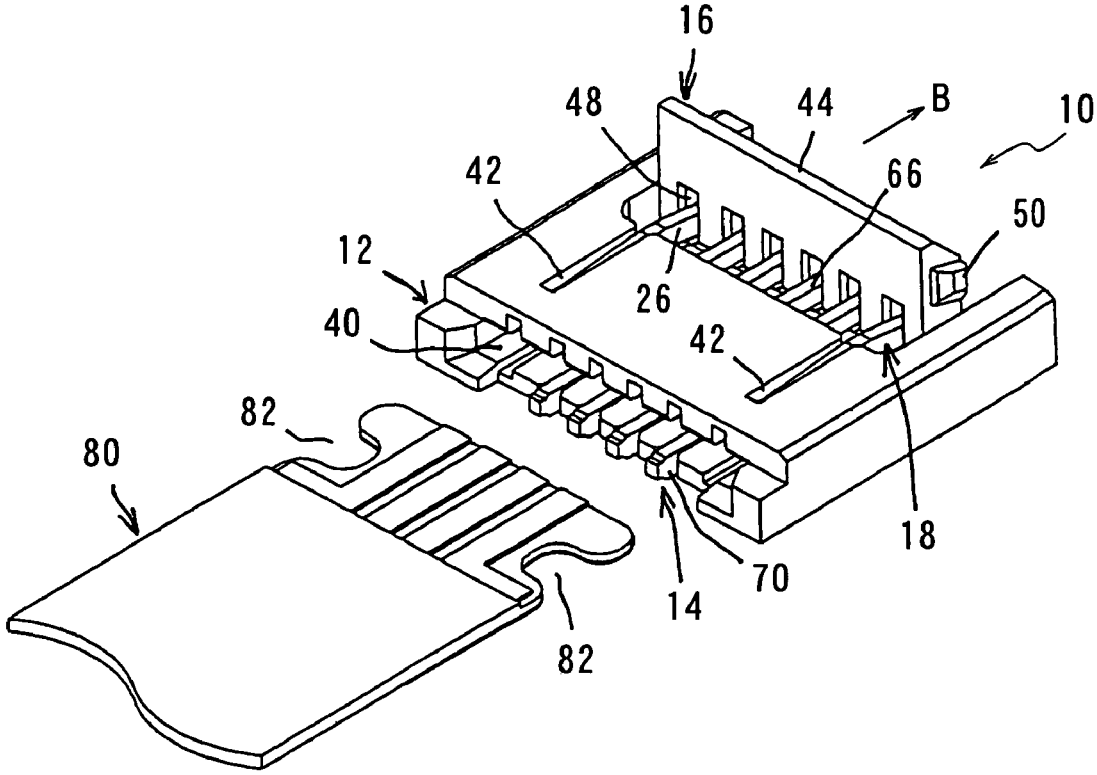
FIG. 1A is a perspective view of the connector according to the invention and a part of a flexible printed circuit board which is not inserted into the connector, viewed from the above on the fitting opening side.
Figure 1B:
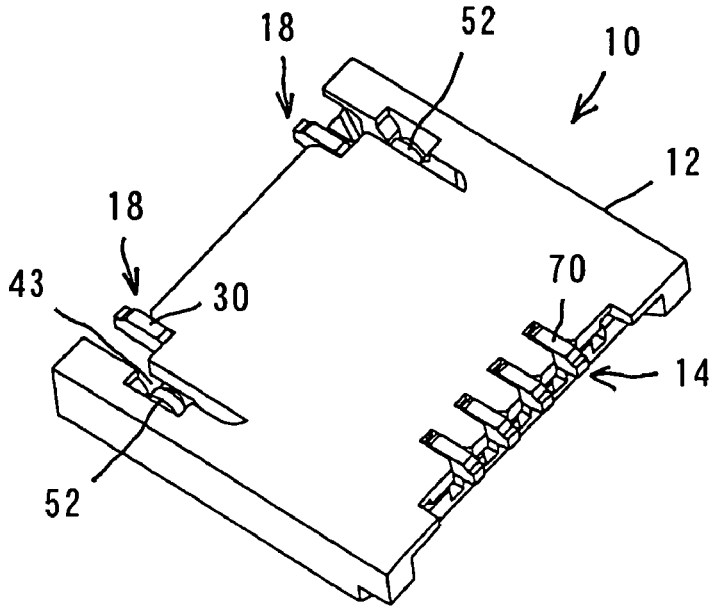
FIG. 1B is a perspective view of the connector shown in FIG. 1A not having the circuit board inserted, viewed from the below on the fitting opening side.
Figure 2:
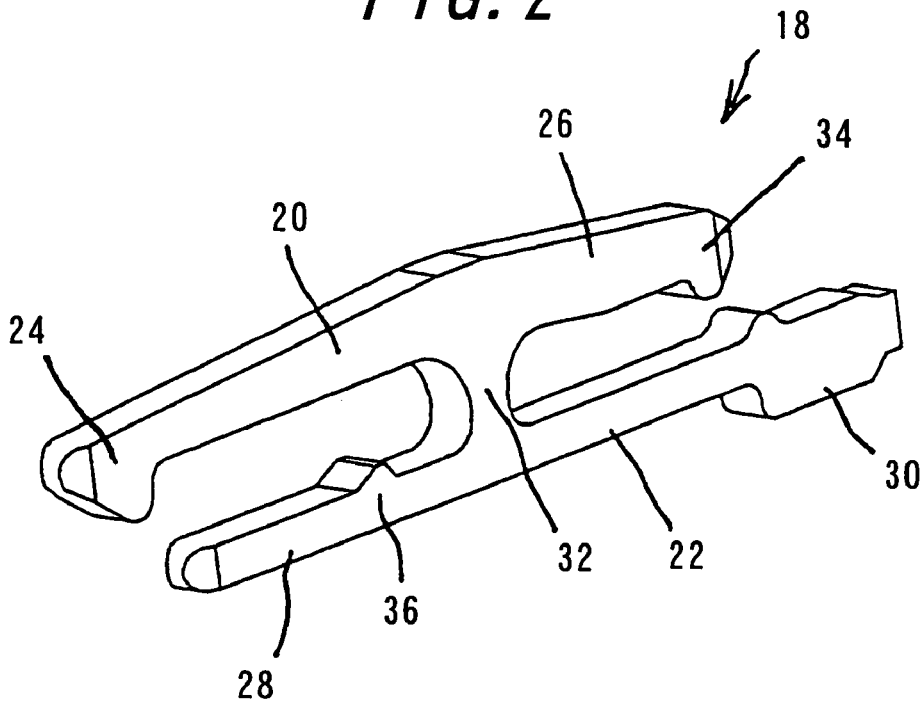
FIG. 2 is a perspective view of a locking member used in the connector.
Figure 3:
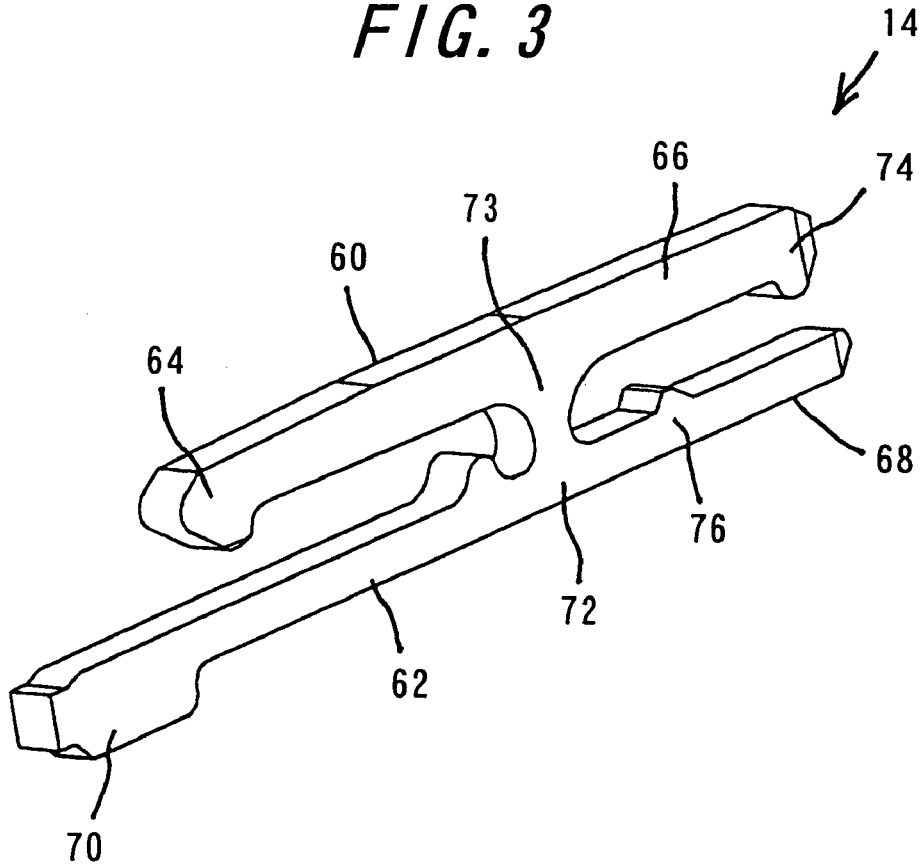
FIG. 3 is a perspective view of a contact used in the connector.
Figure 4:
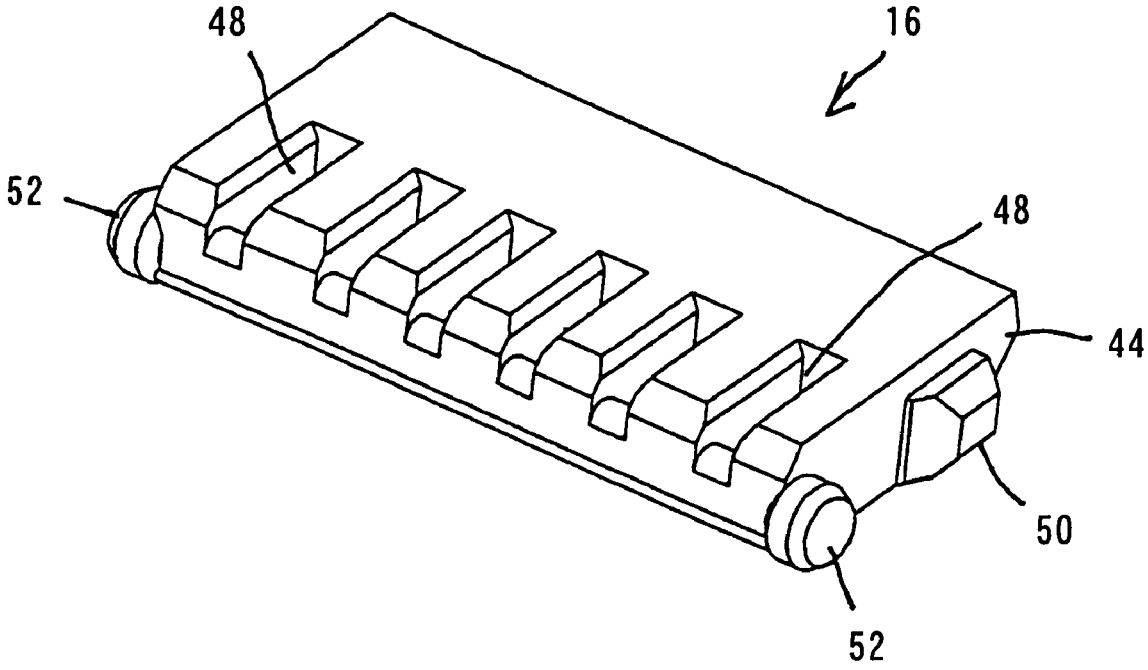
FIG. 4 is a perspective view of a pivoting member used in the connector.
Figure 5A:
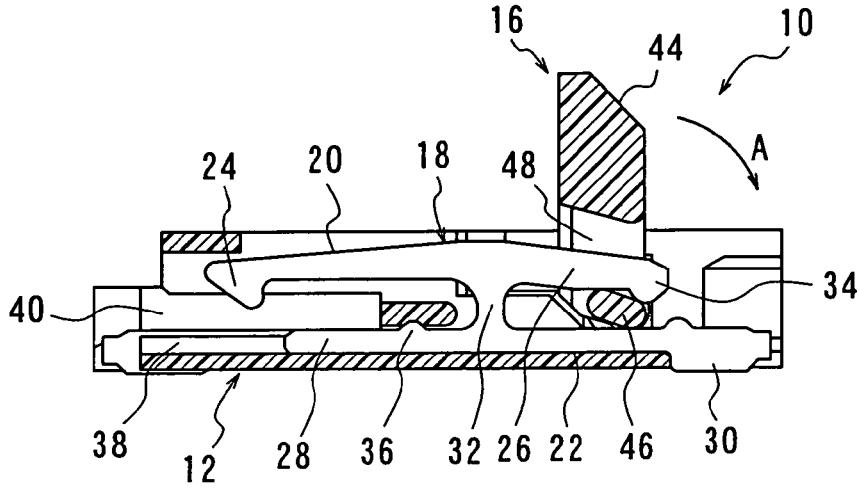
FIG. 5A is a sectional view of the connector not having a flexible printed circuit board inserted, taken along one locking member.
Figure 5B:
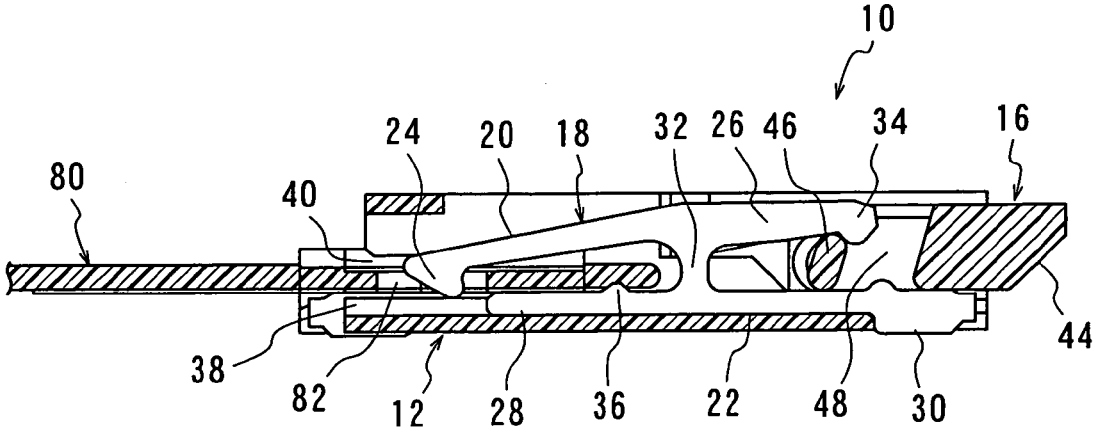
FIG. 5B is a sectional view of the connector with the circuit board inserted, taken along one locking member.
Figure 6A:
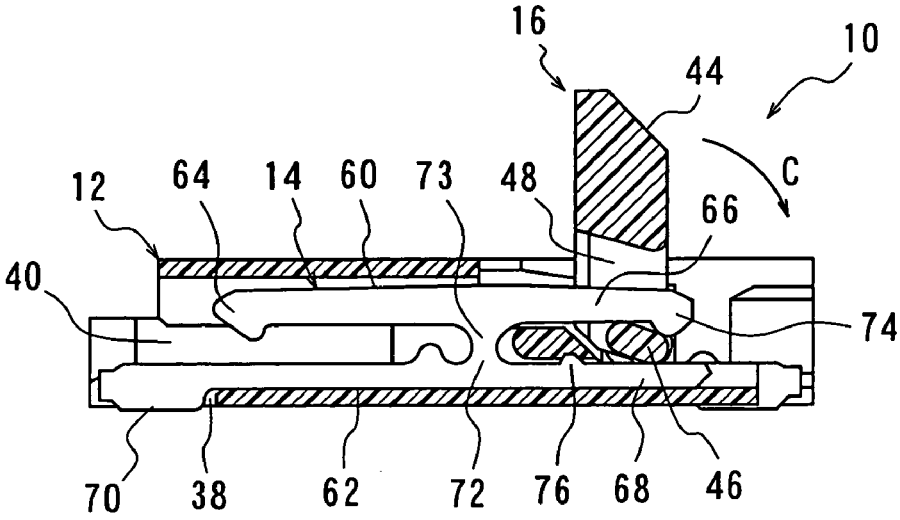
FIG. 6A is a sectional view of the connector not having a circuit board inserted, taken along one contact.
Figure 6B:
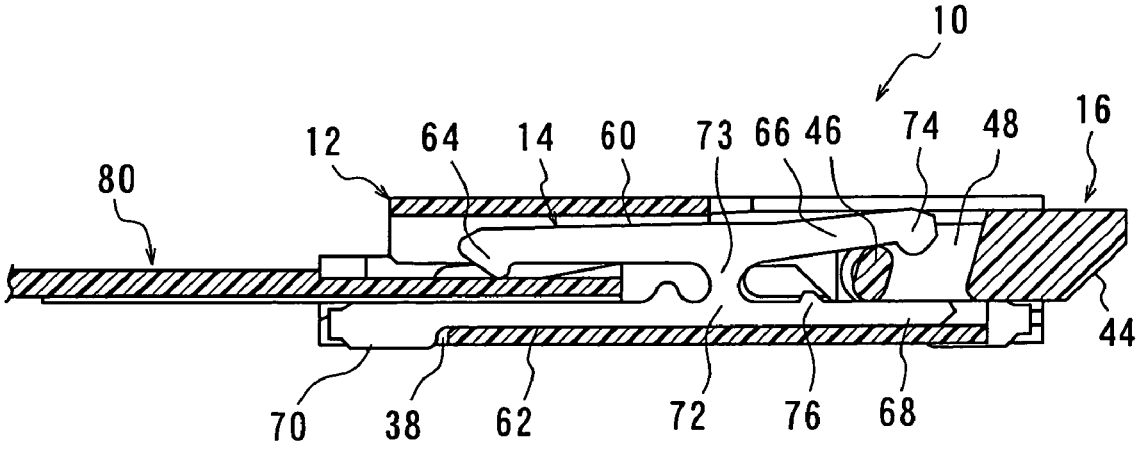
FIG. 6B is a sectional view of the connector with the circuit board inserted, taken along one contact.

One embodiment of the connector according to the invention will be explained with reference to FIGS. 1A to 6B. FIG. 1A is a perspective view of the connector according to the invention and a flexible printed circuit board which is partly removed and has not been inserted into the connector, viewed from the above on the fitting opening side. FIG. 1B is a perspective view of the connector shown in FIG. 1A into which the flexible printed circuit board has not been inserted, viewed from the below on the fitting opening side. FIGS. 2 to 4 are perspective views of a locking member, a contact and a pivoting member used in the connector according to the invention, respectively. FIG. 5A is a sectional view of the connector not having a flexible printed circuit board inserted, taken along one locking member. FIG. 5B is a sectional view of the connector with the inserted flexible printed circuit board, taken along one locking member. FIG. 6A is a sectional view of the connector not having a flexible printed circuit board, taken along one contact. FIG. 6B is a sectional view of the connector with the flexible printed circuit board inserted, taken along one contact.

The connector 10 according to the invention mainly comprises a housing 12, a pivoting member 16, contacts 14, and locking members 18.

Before explaining the components of the connector according to the invention, the flexible printed circuit board 80 will be explained. The flexible printed circuit board 80 at least comprises contact portions adapted to contact respective contact portions 64 of contacts 14, patterns connecting from the contact portions of the circuit board 80 to circuits and anchoring portions 82 adapted to engage the locking members 18. The contact portions of the flexible printed circuit board 81 are arranged only on its upper surface in the illustrated embodiment. Using the flexible printed circuit board 80 formed with the anchoring portions 82, a stable connection state can be maintained without any disturbance even if subjected to vibration or the like, and flexibility is given to the connector by the flexible printed circuit board.

The shape of the anchoring portions 82 may be any one insofar as they can engage engaging portions 24 of the locking members 18. In the illustrated embodiment, the anchoring portions 82 are U-shaped recesses as shown in FIG. 1A, but they may be through-holes or blind holes depending upon specifications.

The components of the connector 10 according to the invention will be explained with reference to the drawings. First, the locking members 18 will be explained, which are a subject matter of the invention. The locking members 18 are made of a metal and formed by means of the press-working of the known technique. Preferred metals from which to form the locking members 18 include brass, beryllium copper, phosphor bronze and the like which comply with the requirements such as springiness, workability and the like.

In the illustrated embodiment, the locking members are in the form of an H-shape as shown in FIG. 2 and each at least comprise a first piece 20 having the engaging portion 24 at one end adapted to engage the anchoring portion 82, a pressure receiving portion 26 at the other end adapted to be urged by the pivoting member 16, and a projection 34 inwardly extending from the tip of the pressure receiving portion 26; a second piece 22 having an extension portion 28 extending toward one end, a fixed portion 36 at a predetermined position on the extension portion 28 to be fixed to the housing 12 and a connection portion 30 at the other end to be connected to a substrate; and a jointing fulcrum portion 32 for connecting the first and second pieces 20 and 22. The engaging portion 24, the jointing fulcrum portion 32, and the pressure receiving portion 26 are arranged substantially in the form of a T-shape.

The second piece 22 is 0.1 mm in height which is 0.05 mm lower than those of the prior art. The height of the second piece 22 may be suitably designed in consideration of the strength and holding power of the locking member 18, the reduced overall height of the connector and the like.

While the connection portion 30 is of the surface mounting type (SMT) in the illustrated embodiment, it may be of a dip type. Positions of the connection portions 30 are on the opposite side of the fitting opening 40.

The jointing fulcrum portions 32 and the pressure receiving portions 26 form a so-called "zero-insertion force (ZIF)" construction which requires little or no insertion force when inserting a flexible printed circuit board. When the flexible printed circuit board 80 is inserted into the fitting opening 40 of the housing 12, the pivoting member 16 is in its opened position. In other words, as shown in FIG. 5A, the urging portion 46 of the pivoting member 16 stands slightly obliquely between the pressure receiving portion 26 and the connection portion 30 of the locking member 18. After the circuit board has been inserted, when the pivoting member 16 is pivotally moved in the direction shown by an arrow A in FIG. 5A, the urging portion 46 stands upright as shown in FIG. 5B to raise the pressure receiving portion 46 upwardly (viewed in the drawing) so that the jointing fulcrum portion 32 is tilted toward the engaging portion 24 about the jointing fulcrum portion itself, with the result that the engaging portion 24 is lowered and comes into contact with the flexible printed circuit board 80 inserted into the fitting opening 40 of the housing 12. Sizes and shapes of the jointing fulcrum portion 32 and the pressure receiving portion 26 may be suitably designed to achieve these functions.

The engaging portions 24 of the locking members 18 are located at positions corresponding to the anchoring portions 82 of the flexible printed circuit board 80, and the locking members 18 are fixed to the housing 12 by means of press-fitting, hooking (lancing) and the like so that the engaging portions 24 are caused to engage the anchoring portions 82 of the circuit board 80. The size of the engaging portions 24 of the locking members 18 may be suitably designed to fulfill the required holding force for a flexible printed circuit board, while shape of the engaging portions 24 may be any one insofar as they can engage the anchoring portions 82 of the flexible printed circuit board 80. The engaging portions 24 are substantially in the form of a right angled triangle, whose vertical faces are caused to engage the surfaces of the anchoring portions 82 of the flexible printed circuit board 80 in the illustrated embodiment.

The length of first piece 20 from the jointing fulcrum portion 32 to the tip end of the engaging portion 24 is longer than the length of the extension portion 28 so that when the locking member 18 engages the flexible printed circuit board 80, the engaging portion 24 does not contact the extension portion 28 and a sufficient displacement of the engaging portion 24 can be obtained by a suitable design. The length of the first piece 20 from the jointing fulcrum portion to the tip end of the engaging portion 24 is approximately 0.2 mm longer than the extension portion 28 in the illustrated embodiment.

In the illustrated embodiment as described above, when the flexible printed circuit board 80 is inserted into the fitting opening 40, the engaging portions 24 do not engage the anchoring portions 82. The pivoting member 16 has to be pivotally moved to permit the engaging portions 24 of the locking members 18 to engage the anchoring portions 82 of the flexible printed circuit board 80.

The fixed portion 36 of the locking member 18 is provided on the extension portion 28 in the proximity of the jointing fulcrum portion 32. The position of the fixed portion 36 may be suitably designed in consideration of the depth of the fitting and effective fitting length of the board 80. As the locking members are fixed to the housing by press-fitting in the illustrated embodiment, there are provided arrow-head members of a size determined in consideration of the holding force for the locking members.

The projections 34 provided on the tips of the pressure receiving portions 26 of the locking members 18 are adapted to engage anchoring holes 48 of the pivoting member 16 when urging portions 46 of the pivoting member 16 are pivotally moved between pressure receiving portions 66 and extension portions 68 of the contacts 14 and between the pressure receiving portions 26 and the connection portions 30 of the locking members 18, so that the mid portion of the pivoting member 16 is prevented from being deformed in the direction shown by an arrow B in FIG. 1A by strong reaction forces against the pivotal movement of the pivoting member 16. It is desired to provide the respective projections on the contacts 14 or the locking members 18, or all of the contacts 14 and the locking members 18. The respective projections are provided on all the contacts and the locking members in the illustrated embodiment.

The locking members 18 in the illustrated embodiment are constructed as described above and shown in FIG. 2. The object of the invention is to achieve even more reduced overall height of the connector, while ensuring a stable holding force for a flexible printed circuit board. For this purpose, it is possible to achieve even more reduced overall height of the connector maintaining required holding force by a combination of notches 42 formed in the housing 12, the locking members 18 not having parts facing to the engaging portions 24, and reduced height of the second pieces 22 of the locking members 18 as discussed below. The most reduced height of the connector is achieved by the combination of all the three features in the illustrated embodiment.

In order to achieve the reduced overall height, a combination is not limited to the combination of the three features. For example, the housing 12 may be provided with the notches 42 and the second pieces 22 each may be provided at one end with a connection portion 30 as is the case with the Patent Literature 4. Moreover, as another combination of the two features, the locking members 18 may not have parts facing to the engaging portions 24, and the second pieces 22 of the locking members 18 may be made thinner. In this case, of course, the housing 12 is not formed with the notches 42.

In the illustrated embodiment, by causing the length of the first piece 20 to be longer than that of the extension portion 28, there is no part of the locking member 18 opposite or facing to the engaging portion 24 as described above. As an alternative, the locking member 18 may not be provided with the extension portion 28 extending from the jointing fulcrum portion 32.

The housing 12 will then be explained which is another subject matter of the invention. The housing 12 is formed from an electrically insulating plastic material by means of the injection molding of the known technique. The materials suitable for the housing 12 include polybutylene terephthalate (PBT), polyamide (66PA or 46PA), liquid crystal polymer (LCP), polycarbonate (PC) and the like and combination thereof in consideration of dimensional stability, workability, manufacturing cost and the like.

The housing 12 is formed with inserting grooves 38 (FIGS. 6A and 6B) for installing a required number of contacts 14, respectively, as shown in FIGS. 1A and 1B. The contacts 14 are fixed in the respective inserting grooves 38 by press-fitting, hooking (lancing), welding or the like. Moreover, the housing 12 is provided at longitudinal ends with bearings 43 for rotatably supporting axles 52 of the pivoting member 16 for its pivotal movement. The shape and size of the bearings 43 may be any shape and size so long as they can receive the axles 52 to permit the pivotal movement of the pivoting member 16 and may be suitably designed in consideration of the function and the strength and size of the housing 12. The housing 12 is further provided at longitudinal ends with anchoring grooves at positions corresponding to locking portions 50 of the pivoting member 16.

Moreover, the housing 12 is provided with a fitting opening 40 for inserting a flexible printed circuit board 80. The housing 12 is further provided with the notches 42 in its upper surface at positions corresponding to the locking members 18. The notches 42 serve to elongate or make higher the jointing fulcrum portions 32 of the locking members 18 to enlarge the displacement of the engaging portions 24 and to achieve the reduced overall height of the connector 10. In other words, even with the construction as in the Patent Literature 4 proposed by the applicant of the present case, by providing the notches 42 in the housing the reduced overall height by 0.15 mm may be achieved, while maintaining the holding force of 3N. The size of the notches 42 may be suitably designed in consideration of such functions and the strength and the like of the housing 12.

The contacts 14 will then be explained with reference to FIG. 3. The contacts 14 are also made of a metal similar to the locking members 18 and formed by means of the press-working of the known technique. Preferred metals from which to form the contacts 14 include brass, beryllium copper, phosphor bronze and the like which comply with the requirements such as springiness, electric conductivity and the like.

The contacts 14 are substantially in the form of an H-shape as shown in FIG. 3. The contact 14 comprises a first piece 60 having a contact portion 64 at one end adapted to contact the flexible printed circuit board 80, a pressure receiving portion 66 at the other end adapted to be urged by the pivoting member 16, and a projection 74 inwardly extending from the tip of the pressure receiving portion 66; a second piece 62 having a connection portion 70 at one end to be connected to a substrate and at the other end an extension portion 68 extending from a fulcrum portion 72; and a jointing portion 73 for connecting the first piece 60 and the fulcrum portion 72 of the second piece 62. The contact portion 64, the jointing portion 73, the fulcrum portion 72, and the connection portion 70 are arranged in the form of a U-shape. The contact portion 64 is in the form of a projection to facilitate to contact the flexible printed circuit board 80. Although the connection portion 70 is of a surface mounting type (SMT) in the illustrated embodiment, it may be of a dip type. Namely, the flexible printed circuit board 80 is embraced between the contact portions 64 and the connection portions 70 to ensure the reliable connection between the contact portions 64 and the circuit board 80.

When the flexible printed circuit board 80 is inserted into the connector, the fulcrum portion 72, the jointing portion 73 and the pressure receiving portion 66 will perform the following functions. After the circuit board 80 has been inserted into the fitting opening 40 of the housing 12, the urging portions 46 of the pivoting member 16 are pivotally moved between the extension portions 68 and the pressure receiving portions 66 of the contacts 14 to raise the pressure receiving portions 66 by the urging portions 46 so that the jointing portions 73 of the contacts 14 are tilted toward the contact portions 64 about the fulcrum portions 72 to urge the contact portions 64 against the flexible printed circuit board 80. Sizes and shapes of the fulcrum portion 72, the jointing portion 73 and the pressure receiving portions 66 may be suitably designed to achieve these functions. It is also desirable to provide at the tips of the pressure receiving portions 66 the respective projections 74 which are caused to engage anchoring holes 48 of the pivoting member 16 when the urging portions 46 of the pivoting member 16 are pivotally moved between the pressure receiving portions 66 and the extension portions 68 of the contacts 14, thereby preventing the center of the pivoting member 16 from being deformed in the direction shown by the arrow B in FIG. 1A due to strong reaction forces against the pivotal movement of the pivoting member 16. The size of the projections 74 may be arbitrary so long as they can achieve their functions and may be suitably designed to cause the projections 74 to engage the anchoring holes 48 of the pivoting member 16.

A fixed portion 76 is provided on the extension portion 68 in the proximity of the fulcrum portion 72. The position of the fixed portion 76 may be suitably designed in consideration of easy assembling and spaces for the pivotal movement of the urging portion 46. As the contacts are fixed to the housing by press-fitting in the illustrated embodiment, there are provided arrow-head members of a size determined in consideration of the holding force for the contacts.

Finally, the pivoting member 16 will be explained. The pivoting member 16 is formed from an electrically insulating plastic material by means of the injection molding of the known technique. The materials suitable for the pivoting member 16 include polybutylene terephthalate (PBT), polyamide (66PA or 46PA), liquid crystal polymer (LCP), polycarbonate (PC) and the like and combination thereof in consideration of dimensional stability, workability, manufacturing cost and the like. The pivoting member 16 mainly comprises an actuating portion 44, axles 52 adapted to be fitted in the housing 12 for pivotal movement of the pivoting member 16 relative to the housing 12, the urging portions 46 for urging the pressure receiving portions 66 and 26 of the contacts 14 and the locking members 18, and the anchoring holes 48 to be engaged by the pressure receiving portions 66 and 26 of the contacts 14 and the locking members 18. The axles 52 are a fulcrum for pivotally moving the pivoting member 16 and rotatably supported in the bearings 43 in the housing 12 at its longitudinal ends. The axles 52 are each formed with a chamfered or flat portion at their upper portion for the purpose of facilitating installing the axles 52 into the bearings 43 of the housing 12 and avoiding the axles from abutting against the housing during the pivotal movement of the pivoting member. The pivoting member 16 is further provided at its longitudinal ends with locking portions 50 adapted to engage the housing 12 for preventing the pivoting member 16 from being raised upwardly (viewed in the drawing) when raising the pressure receiving portions 66 of the contacts 14. The shape and size of the locking portions 50 may be arbitrary insofar as they can engage the housing 12 and may be suitably designed in consideration of the above function and the size, strength and the like of the connector.

The urging portions 46 are pivotally moved between the pressure receiving portions 66 and the extension portions 68 of the contacts 14 and between the pressure receiving portions 26 and the connection portions 30 of the locking members 18 so as to urge the pressure receiving portions 66 and 26. The urging portions are preferably of an elongated shape, elliptical in the illustrated embodiment. With such an elliptical shape, when the pivoting member 16 is pivotally moved from the state shown in FIG. 5A or 6A to the state shown in FIG. 5B or 6B in the direction shown by an arrow A or C so as to pivotally move its urging portions between the pressure receiving portions 66 and the extension portions 68 of the contacts 14 and between the pressure receiving portions 26 and the connection portions 30 of the locking members 18, the pressure receiving portions 66 and 26 of the contacts 14 and the locking members 18 are moved upward with the aid of the variation in contact height owing to, for example, difference in major and minor axes of an ellipse, and the contact portions 64 of the contacts 14 and the engaging portions 24 of the locking members 18 are moved downward so that the contact portions 64 are brought into contact with the flexible printed circuit board 80, and the engaging portions 24 are brought into engagement with the anchoring portions 82 of the circuit board 80. The shape of the urging portions 46 may be arbitrary so long as they can be rotated between the pressure receiving portions 66 and the extension portions 68 of the contacts 14 and between the pressure receiving portions 26 and the connection portions 30 of the locking members 18, and the pressure receiving portions 66 and 26 of the contacts 14 and the locking members 18 can be raised with the aid of the variation in contact height such as a difference in major and minor axes of the ellipse.

The pivoting member 16 is further provided with the anchoring holes 48 independently from one another which are adapted to be engaged by the projections 74 and 34 of the contacts 14 and locking members 18, in order to prevent the center of the pivoting member 16 from being deformed in the direction shown by the arrow B in FIG. 1A owing to the strong reaction forces against the pivotal movement of the pivoting member 16 when it is pivotally moving. The anchoring holes 48 provided independently from one another contribute to enhancing the strength of the pivoting member 16 and prevent the deformation of the pivoting member when it is pivotally moving.

Examples of applications of the present invention are connectors for use in various kinds of mobiles, backlight liquid crystal displays and the like, and connectors capable of reliably locking a flexible printed circuit board which has been inserted into the connector.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A connector detachably fitted with a flexible printed circuit board, including a plurality of contacts each having a contact portion to contact said flexible printed circuit board, a housing holding and fixing said contacts and having a fitting opening into which the flexible printed circuit board is inserted, locking members adapted to engage said flexible printed circuit board, and a pivoting member causing said contacts and said locking members to be elastically deformed, wherein said flexible printed circuit board is provided with anchoring portions, and said locking members each comprise a first piece having an engaging portion at one end adapted to engage said anchoring portion of the flexible printed circuit board, a pressure receiving portion at the other end adapted to be urged by said pivoting member, and a projection inwardly extending from the tip of said pressure receiving portion; a second piece having a connection portion at one end or the other end to be connected to a substrate; and a jointing fulcrum portion for connecting said first piece and the other end or the one end of said second piece; said locking members being installed on said housing, and wherein said housing is provided with notches on the side of its upper surface at positions corresponding to said locking members.

2. A connector detachably fitted with a flexible printed circuit board, including a plurality of contacts each having a contact portion to contact said flexible printed circuit board, a housing holding and fixing said contacts and having a fitting opening into which the flexible printed circuit board is inserted, locking members adapted to engage said flexible printed circuit board, and a pivoting member causing said contacts and said locking members to be elastically deformed, wherein said flexible printed circuit board is provided with anchoring portions, and said locking members each comprise a first piece having an engaging portion, having a tip, at one end adapted to engage said anchoring portion of the flexible printed circuit board, a pressure receiving portion, having a tip, at the other end adapted to be urged by said pivoting member, and a projection inwardly extending from said tip of said pressure receiving portion; a second piece having a connection portion at one end to be connected to a substrate; and a jointing fulcrum portion for connecting said first piece and the other end of said second piece; said locking members being installed on said housing, and wherein said [second pieces are void of parts at positions facing to said engaging portions of said first piece when said pivoting member is pivotally moved to bring said engaging portions of the locking members into engagement with said anchoring portions of said flexible printed circuit board] first piece of said locking member is arranged such that a length from said jointing fulcrum portion to said tip of said engaging portion is greater than a length of a portion of said second piece extending from said jointing fulcrum portion to an end thereof, to thereby prevent contact between said engaging portion and said end of said second piece when said locking member engages said flexible printed board.

3. The connector as set forth in claim 2, wherein the second pieces are 0.08 to 0.12 mm in height.

4. The connector as set forth in claim 2, wherein said second pieces each include an extension portion extending from said jointing fulcrum portion in such a direction that said extension portion faces to said engaging portion, and the length of said extension portion is shorter than the distance from the jointing fulcrum portion to the engaging portion so that said extension portions stop short of the positions facing to said engaging portions when the pivoting member is pivotally moved to bring said engaging portions of the locking members into engagement with said anchoring portions of said flexible printed circuit board.

5. The connector as set forth in claim 4, wherein said second pieces are each provided with a fixed portion between the tip of said extension portion and said jointing fulcrum portion.

6. The connector as set forth in claim 1, wherein said contacts each comprise a first piece having a contact portion at one end adapted to contact said flexible printed circuit board, a pressure receiving portion at the other end adapted to be urged by said pivoting member, and a projection inwardly extending from the tip of said pressure receiving portion; a second piece having a connection portion at one end to be connected to a substrate and at the other end an extension portion extending from a fulcrum portion; and a jointing portion for connecting said first piece and said fulcrum portion of the second piece; said contact portion, said jointing portion, said fulcrum portion, and said connection portion are arranged substantially in the form of a U-shape, and wherein said pivoting member comprises an actuating portion for pivotally moving the pivoting member, urging portions arranged continuously in the longitudinal direction, and anchoring holes into which said pressure receiving portions of the contacts and the locking members can be inserted, and said pivoting member is installed on said housing so that said urging portions are pivotally moved between said pressure receiving portions and said extension portions of the contacts and between said pressure receiving portions and said connection portions of said locking members.

7. The connector as set forth in claim 3, wherein said second pieces each include an extension portion extending from said jointing fulcrum portion in such a direction that said extension portion faces to said engaging portion, and the length of said extension portion is shorter than the distance from the jointing fulcrum portion to the engaging portion so that said extension portions stop short of the positions facing to said engaging portions when the pivoting member is pivotally moved to bring said engaging portions of the locking members into engagement with said anchoring portions of said flexible printed circuit board.

8. The connector as set forth in claim 7, wherein said second pieces are each provided with a fixed portion between the tip of said extension portion and said jointing fulcrum portion.

9. The connector as set forth in claim 2, wherein said contacts each comprise a first piece having a contact portion at one end adapted to contact said flexible printed circuit board, a pressure receiving portion at the other end adapted to be urged by said pivoting member, and a projection inwardly extending from the tip of said pressure receiving portion; a second piece having a connection portion at one end to be connected to a substrate and at the other end an extension portion extending from a fulcrum portion; and a jointing portion for connecting said first piece and said fulcrum portion of the second piece; said contact portion, said jointing portion, said fulcrum portion, and said connection portion are arranged substantially in the form of a U-shape, and wherein said pivoting member comprises an actuating portion for pivotally moving the pivoting member, urging portions arranged continuously in the longitudinal direction, and anchoring holes into which said pressure receiving portions of the contacts and the locking members can be inserted, and said pivoting member is installed on said housing so that said urging portions are pivotally moved between said pressure receiving portions and said extension portions of the contacts and between said pressure receiving portions and said connection portions of said locking members.

10. The connector as set forth in claim 3, wherein said contacts each comprise a first piece having a contact portion at one end adapted to contact said flexible printed circuit board, a pressure receiving portion at the other end adapted to be urged by said pivoting member, and a projection inwardly extending from the tip of said pressure receiving portion; a second piece having a connection portion at one end to be connected to a substrate and at the other end an extension portion extending from a fulcrum portion; and a jointing portion for connecting said first piece and said fulcrum portion of the second piece; said contact portion, said jointing portion, said fulcrum portion, and said connection portion are arranged substantially in the form of a U-shape, and wherein said pivoting member comprises an actuating portion for pivotally moving the pivoting member, urging portions arranged continuously in the longitudinal direction, and anchoring holes into which said pressure receiving portions of the contacts and the locking members can be inserted, and said pivoting member is installed on said housing so that said urging portions are pivotally moved between said pressure receiving portions and said extension portions of the contacts and between said pressure receiving portions and said connection portions of said locking members.

11. The connector as set forth in claim 4, wherein said contacts each comprise a first piece having a contact portion at one end adapted to contact said flexible printed circuit board, a pressure receiving portion at the other end adapted to be urged by said pivoting member, and a projection inwardly extending from the tip of said pressure receiving portion; a second piece having a connection portion at one end to be connected to a substrate and at the other end an extension portion extending from a fulcrum portion; and a jointing portion for connecting said first piece and said fulcrum portion of the second piece; said contact portion, said jointing portion, said fulcrum portion, and said connection portion are arranged substantially in the form of a U-shape, and wherein said pivoting member comprises an actuating portion for pivotally moving the pivoting member, urging portions arranged continuously in the longitudinal direction, and anchoring holes into which said pressure receiving portions of the contacts and the locking members can be inserted, and said pivoting member is installed on said housing so that said urging portions are pivotally moved between said pressure receiving portions and said extension portions of the contacts and between said pressure receiving portions and said connection portions of said locking members.

12. The conne ctor as set forth in claim 5, wherein said contacts each comprise a first piece having a contact portion at one end adapted to contact said flexible printed circuit board, a pressure receiving portion at the other end adapted to be urged by said pivoting member, and a projection inwardly extending from the tip of said pressure receiving portion; a second piece having a connection portion at one end to be connected to a substrate and at the other end an extension portion extending from a fulcrum portion; and a jointing portion for connecting said first piece and said fulcrum portion of the second piece; said contact portion, said jointing portion, said fulcrum portion, and said connection portion are arranged substantially in the form of a U-shape, and wherein said pivoting member comprises an actuating portion for pivotally moving the pivoting member, urging portions arranged continuously in the longitudinal direction, and anchoring holes into which said pressure receiving portions of the contacts and the locking members can be inserted, and said pivoting member is installed on said housing so that said urging portions are pivotally moved between said pressure receiving portions and said extension portions of the contacts and between said pressure receiving portions and said connection portions of said locking members.

13. The connector as set forth in claim 6, wherein said contacts each comprise a first piece having a contact portion at one end adapted to contact said flexible printed circuit board, a pressure receiving portion at the other end adapted to be urged by said pivoting member, and a projection inwardly extending from the tip of said pressure receiving portion; a second piece having a connection portion at one end to be connected to a substrate and at the other end an extension portion extending from a fulcrum portion; and a jointing portion for connecting said first piece and said fulcrum portion of the second piece; said contact portion, said jointing portion, said fulcrum portion, and said connection portion are arranged substantially in the form of a U-shape, and wherein said pivoting member comprises an actuating portion for pivotally moving the pivoting member, urging portions arranged continuously in the longitudinal direction, and anchoring holes into which said pressure receiving portions of the contacts and the locking members can be inserted, and said pivoting member is installed on said housing so that said urging portions are pivotally moved between said pressure receiving portions and said extension portions of the contacts and between said pressure receiving portions and said connection portions of said locking members.

14. The connector as set forth in claim 7, wherein said contacts each comprise a first piece having a contact portion at one end adapted to contact said flexible printed circuit board, a pressure receiving portion at the other end adapted to be urged by said pivoting member, and a projection inwardly extending from the tip of said pressure receiving portion; a second piece having a connection portion at one end to be connected to a substrate and at the other end an extension portion extending from a fulcrum portion; and a jointing portion for connecting said first piece and said fulcrum portion of the second piece; said contact portion, said jointing portion, said fulcrum portion, and said connection portion are arranged substantially in the form of a U-shape, and wherein said pivoting member comprises an actuating portion for pivotally moving the pivoting member, urging portions arranged continuously in the longitudinal direction, and anchoring holes into which said pressure receiving portions of the contacts and the locking members can be inserted, and said pivoting member is installed on said housing so that said urging portions are pivotally moved between said pressure receiving portions and said extension portions of the contacts and between said pressure receiving portions and said connection portions of said locking members.

15. The connector as set forth in claim 8, wherein said contacts each comprise a first piece having a contact portion at one end adapted to contact said flexible printed circuit board, a pressure receiving portion at the other end adapted to be urged by said pivoting member, and a projection inwardly extending from the tip of said pressure receiving portion; a second piece having a connection portion at one end to be connected to a substrate and at the other end an extension portion extending from a fulcrum portion; and a jointing portion for connecting said first piece and said fulcrum portion of the second piece; said contact portion, said jointing portion, said fulcrum portion, and said connection portion are arranged substantially in the form of a U-shape, and wherein said pivoting member comprises an actuating portion for pivotally moving the pivoting member, urging portions arranged continuously in the longitudinal direction, and anchoring holes into which said pressure receiving portions of the contacts and the locking members can be inserted, and said pivoting member is installed on said housing so that said urging portions are pivotally moved between said pressure receiving portions and said extension portions of the contacts and between said pressure receiving portions and said connection portions of said locking members.

* * * * *